US007070389B2

(12) United States Patent
Kim et al.

(10) Patent No.: US 7,070,389 B2
(45) Date of Patent: Jul. 4, 2006

(54) TURBOFAN AND METHOD OF MANUFACTURING THE SAME

(75) Inventors: Jin Baek Kim, Suwon (KR); Hyoung-Mo Koo, Anyang (KR); Weon-Seok Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 52 days.

(21) Appl. No.: 10/748,195

(22) Filed: Dec. 31, 2003

(65) Prior Publication Data

US 2004/0258519 A1 Dec. 23, 2004

(30) Foreign Application Priority Data

Jun. 3, 2003 (KR) ..... 10-2003-0035566

(51) Int. Cl.
*F04D 29/38* (2006.01)

(52) U.S. Cl. ..... 416/185; 416/213 R; 416/214 R

(58) Field of Classification Search ..... 415/206, 415/208.2, 209.3, 209.4, 210.1, 215.1; 416/182, 416/185, 195, 213 R, 214 R, 214 A
See application file for complete search history.

(56) References Cited

U.S. PATENT DOCUMENTS 1,919,970 A * 7/1933 Woods ..... 416/184
2,482,462 A * 9/1949 Browne ..... 416/186 R
3,842,902 A 10/1974 Poslusny
6,146,094 A * 11/2000 Obana et al. ..... 415/200
6,558,120 B1 5/2003 Kim et al.
6,604,906 B1 8/2003 Ozeki et al.
6,746,210 B1 6/2004 Kim
6,848,887 B1 2/2005 Kim
6,942,459 B1 9/2005 Li et al.
2003/0077174 A1 4/2003 Kim

FOREIGN PATENT DOCUMENTS

JP 1-193099 8/1989

OTHER PUBLICATIONS

Korean Patent Abstracts for Publication No. 1020020086142, dated Nov. 18, 2002.
Korean Patent Abstracts for Publication No. 1020030012623, dated Feb. 12, 2003.
Patent Abstracts of Japan for Publication No. 07-016884, dated Jan. 20, 1995.
Korean Patent Abstracts for Publication No. 1020020086142, dated Nov. 18, 2002.
Patent Abstracts of Japan for Publication No. 07-016884, dated Jan. 20, 1995.
Korean Patent Abstracts for Publication No. 1020030012623, dated Feb. 12, 2003.

(Continued)

*Primary Examiner*—Edward K. Look
*Assistant Examiner*—Dwayne J White
(74) *Attorney, Agent, or Firm*—Staas & Halsey LLP

(57) ABSTRACT

A method of manufacturing a turbofan, which facilitates a manufacturing process and reduces a defective fraction of products during the manufacturing process by providing joining portions of the turbofan with corresponding plane surfaces. The turbofan includes a rotating plate coupled at a center thereof to a shaft of a drive motor, a plurality of blades radially arranged on a peripheral area of a front face of the rotating plate, and a ring-shaped shroud coupled to front ends of the plurality of blades. The method includes forming the ring-shaped shroud and first parts of the plurality of blades integrally, forming the rotating plate and remaining second parts of the plurality of blades integrally, and joining the first parts to corresponding second parts by fusion bonding.

4 Claims, 6 Drawing Sheets

OTHER PUBLICATIONS

U.S. Appl. No. 10/748,229, filed Dec. 31, 2003, Jin Baek Kim et al., Samsung Electronics Co., Ltd., Suwon-si, Republic of Korea.

U.S. Appl. No. 10/748,230, filed Dec. 31, 2003, Jin Baek Kim et al., Samsung Electronics Co., Ltd., Suwon-si, Republic of Korea.

* cited by examiner

PRIOR ART

PRIOR ART

TURBOFAN AND METHOD OF MANUFACTURING THE SAME

CROSS-REFERENCE TO RELATED APPLICATION

This application claims the benefit of Korean Application No. 2003-35566, filed Jun. 3, 2003, in the Korean Intellectual Property Office, the disclosure of which is incorporated herein by reference.

BACKGROUND OF THE INVENTION

1. Field of the Invention

The present invention relates to a turbofan and a method of manufacturing the same, and more particularly, to a turbofan and a method of manufacturing the same, which facilitates a manufacturing process and reduces a defective fraction of products during the manufacturing process of the turbofan.

2. Description of the Related Art

Generally, a turbofan is a kind of centrifugal fan, which is adapted to blow air generated from rotating blades. As shown in FIG. 1, the turbofan comprises a circular rotating plate 1 having a central hub 1*a* to which a rotating shaft of a drive motor (not shown) couples, a plurality of blades 2 which are radially disposed at a periphery of the circular rotating plate 1 with regular intervals therebetween such that the plurality of blades 2 are positioned to be perpendicular to the circular rotating plate 1, and a ring-shaped shroud 3 joining to free ends of the plurality of blades 2 to support the plurality of blades 2.

The turbofan is usually produced by a plastic injection molding process. Since a configuration of the turbofan is complicated, the turbofan is provided with a number of undercuts on the plurality of blades 2 thereof, thereby causing a separation of a mold therefrom to be difficult. Thus, the turbofan is hard to integrally mold by only one molding process. To overcome this disadvantage, a conventional turbofan is produced in such a way that a part A, in which the circular rotating plate 1 and the plurality of blades 2 are integrally molded, and the shroud part 4 are first molded by separate molds, as shown in FIG. 2, and the part A and the shroud part 4 are combined with each other by an ultrasonic fusion or a heat fusion in a subsequent procedure.

In a conventional process of manufacturing turbofans, since a procedure of combining the shroud part 4 with ends 2*a* of the plurality of blades 2 by the ultrasonic fusion or the heat fusion is not precisely achieved, a problem occurs that a high portion of the product is defective. More specifically, since the ring-shaped shroud 3 and the ends 2*a* of the plurality of blades 2 joining to the ring-shaped shroud 3 have inclined and curved surfaces corresponding to each other, the plurality of blades 2 deviate from the ring-shaped shroud 3 in inward or outward directions during a joining procedure. Thus, to precisely join the plurality of blades 2 to desired portions of the ring-shaped shroud 3 is difficult. Accordingly, where a joined state of the plurality of blades 2 and the ring-shaped shroud 3 is not correct, a bonding strength of the plurality of blades 2 and the ring-shaped shroud 3 is lowered and a performance of the turbofan is lowered.

SUMMARY OF THE INVENTION

Accordingly, it is an aspect of the present invention to provide a turbofan and a method of manufacturing the turbofan, which facilitates a manufacturing process of turbofan and reduces a defective fraction of products during the manufacturing process of turbofan by providing joining portions of the turbofan with corresponding plane surfaces.

Additional aspects and/or advantages of the invention will be set forth in part in the description which follows and, in part, will be obvious from the description, or may be learned by practice of the invention.

The above and/or other aspects are achieved by providing a turbofan including a rotating plate coupled at a center thereof to a shaft of a drive motor, a plurality of blades radially arranged on a peripheral area of a front face of the rotating plate, in which each of the plurality of blades includes a first blade part integrally formed with a ring-shaped shroud and extending in a direction toward the rotating plate with an end thereof having a plane surface, and a second blade part integrally formed with the rotating plate and extending in a direction toward the ring-shaped shroud with an end thereof having a plane surface corresponding to the plane surface of the first blade part, the first and second blade parts joining to each other at the corresponding plane surfaces by fusion bonding; and the ring-shaped shroud coupled to front ends of the second blade parts.

The above and/or other aspects are achieved by providing a turbofan including a rotating plate coupled at a center thereof to a shaft of a drive motor, a plurality of blades radially arranged on a peripheral area of a front face of the rotating plate, in which rear ends of the plurality of blades have plane surfaces corresponding to the front face of the rotating plate and join to the front face of the rotating plate by fusion bonding, and a ring-shaped shroud integrally formed with front ends of the plurality of the blades.

The above and/or other aspects are achieved by providing a method of manufacturing a turbofan including a rotating plate coupled at a center thereof to a shaft of a drive motor, a plurality of blades radially arranged on a peripheral area of a front face of the rotating plate, and a ring-shaped shroud coupled to front ends of the plurality of the blades, the method including forming the ring-shaped shroud and first parts of the plurality of blades integrally, forming the rotating plate and a remaining second parts of the plurality of blades integrally, and joining the first parts of the plurality of blades to the second parts of the plurality of blades by fusion bonding.

Ends of the first parts of the plurality of blades and ends of the second parts of the plurality of blades may have plane surfaces parallel to the front face of the rotating plate.

The above and/or other aspects are achieved by providing a method of manufacturing a turbofan including a rotating plate coupled at a center thereof to a shaft of a drive motor, a plurality of blades radially arranged on a peripheral area of a front face of the rotating plate, and a ring-shaped shroud coupled to front ends of the plurality of the blades, the method including forming the ring-shaped shroud and the plurality of blades integrally, in which front ends of the plurality of blades having plane surfaces corresponding to the front face of the rotating plate, and joining the front ends of the plurality of blades to the front face of the rotating plate by fusion bonding.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
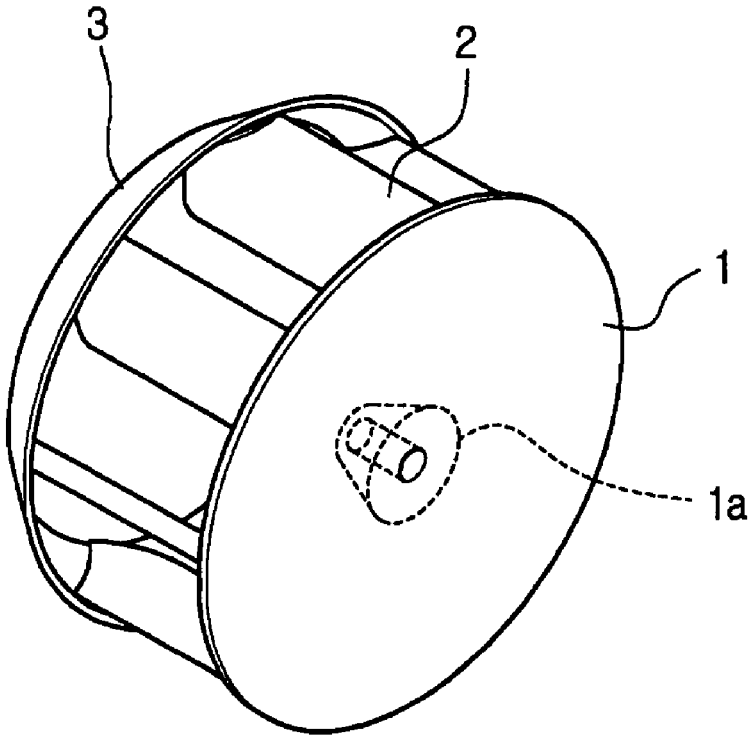
FIG. 1 is a perspective view of a conventional turbofan.
Figure 2:
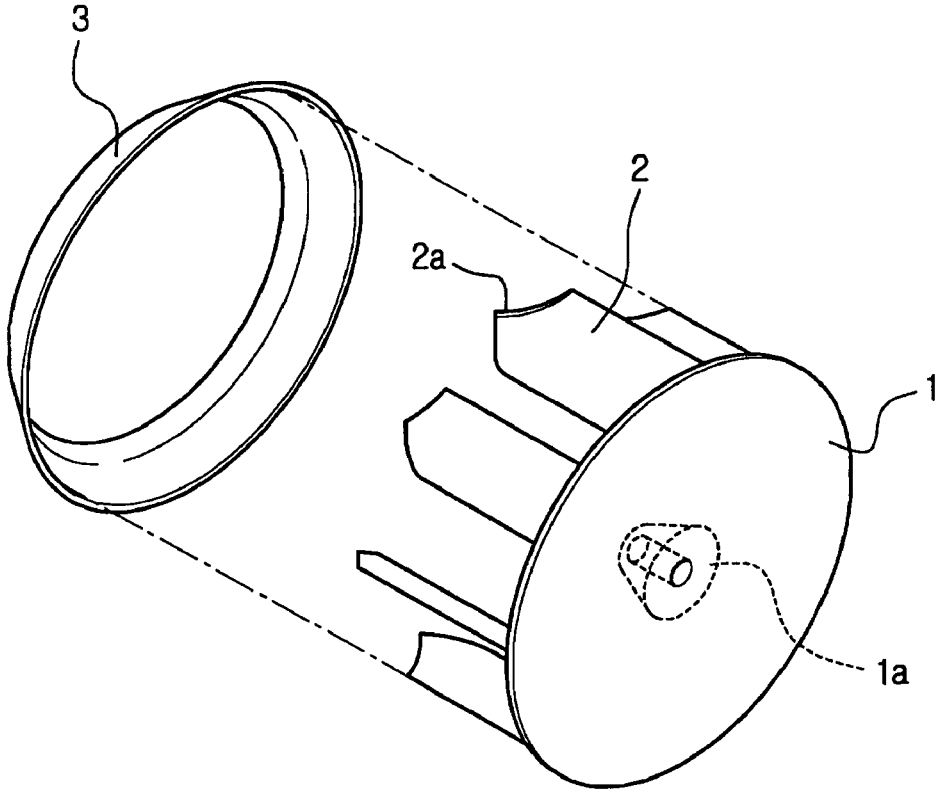
FIG. 2 is an exploded perspective view of the turbofan of FIG. 1.
Figure 3:
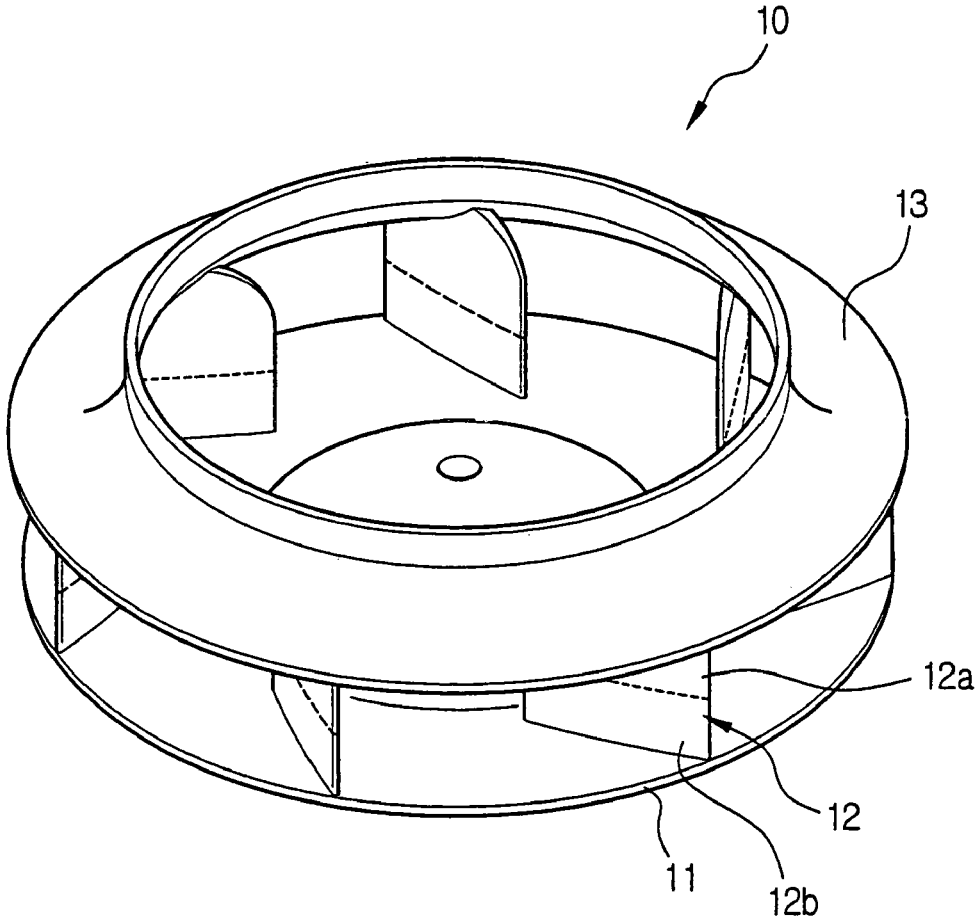
FIG. 3 is a perspective view of a turbofan according to a first embodiment of the present invention.
Figure 4:
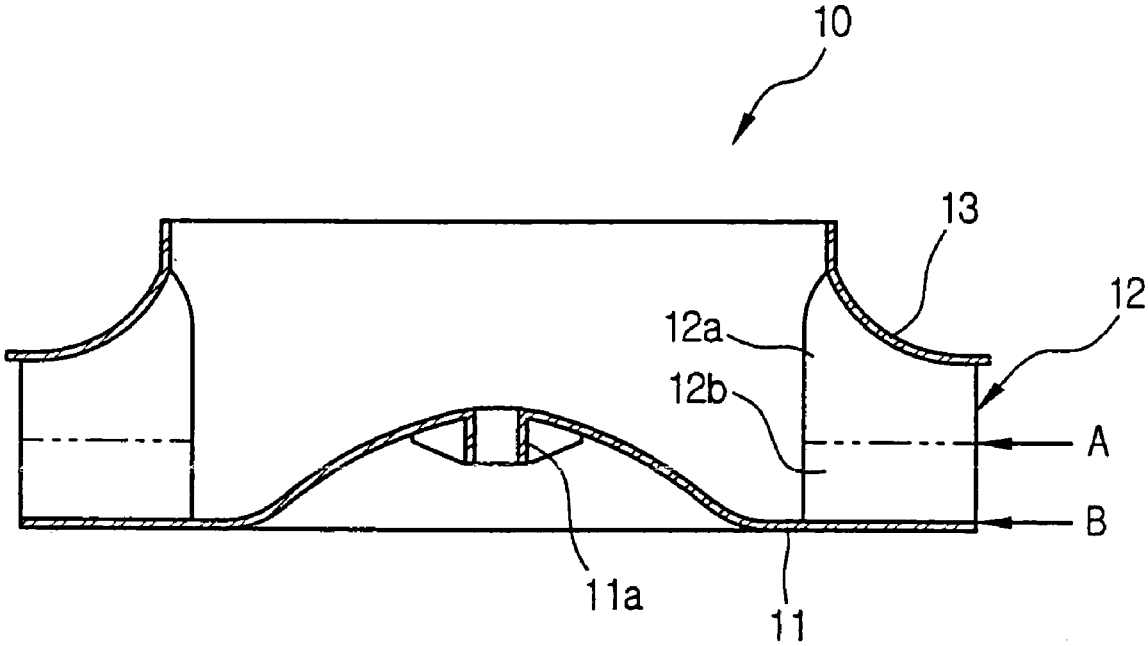
FIG. 4 is a cross-sectional view of the turbofan shown in FIG. 3.

Reference will now be made in detail to the present preferred embodiments of the present invention, examples of which are illustrated in the accompanying drawings, wherein like reference numerals refer to like elements throughout FIG. 3 is a perspective view of a turbofan according to a first embodiment of the present invention, and FIG. 4 is a cross-sectional view of the turbofan shown in FIG. 3.

As shown in FIGS. 3 and 4, a turbofan 10 includes a circular rotating plate 11 having a central hub 11*a*integrally formed therewith and into which a rotating shaft of a drive motor (not shown) fits, and a plurality of blades 12 which are radially arranged on a front face of the circular rotating plate 11 and connected at rear ends thereof to the circular rotating plate 11. The turbofan 10 further includes a ring-shaped shroud 13 integrally formed with front ends of the plurality of blades 12 and spaced apart from the circular rotating plate 11.

When the circular rotating plate 11 is coupled to a drive motor (not shown), a center portion of the circular rotating plate 11 protrudes in a forward direction into a dome shape, so as to enable the turbofan 10 to stably rotate. As shown FIG. 3, the plurality of blades 12 are, respectively, inclined at a certain angle with respect to a radial direction thereof passing through a corresponding blade 12. The ring-shaped shroud 13 is curled at an inner peripheral portion thereof to have a certain curvature, thereby allowing air introduced into the turbofan 10 to smoothly and radially discharge.

Figure 5:
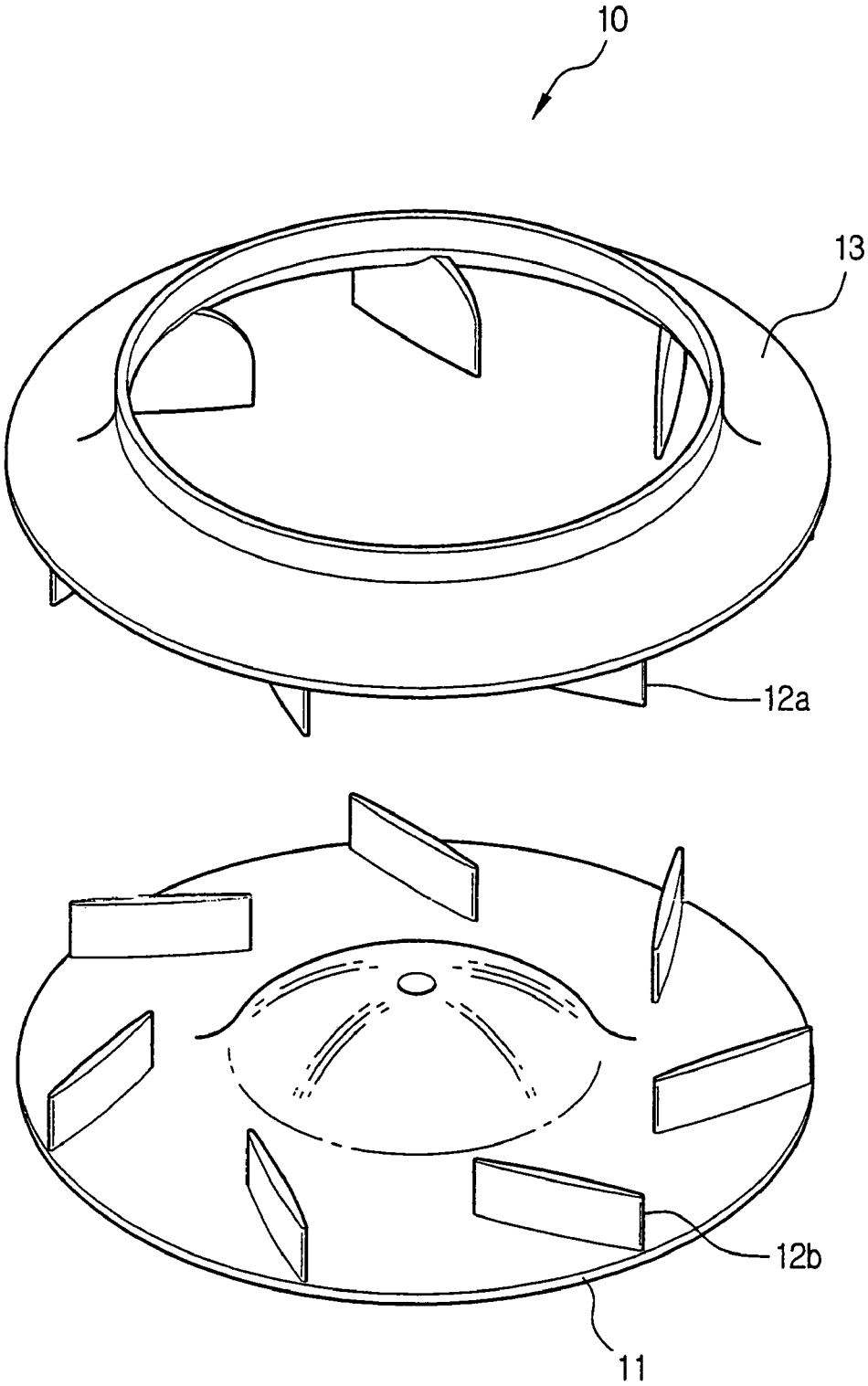
FIG. 5 is an exploded perspective view showing a process of manufacturing a turbofan, according to a second embodiment of the present invention.

As shown in FIG. 5, a process of manufacturing the turbofan 10, according to a second embodiment of the present invention, is carried out as follows. The ring-shaped shroud 13 and first upper blade parts 12*a* are integrally molded from a resin material by an injection molding, and the circular rotating plate 11 and second lower blade parts 12*b* are integrally molded from the resin material by a second injection molding. That is, a first molded product is prepared by integrally molding the ring-shaped shroud 13 and the first blade parts 12*a* by a first mold, and a second molded product is prepared by integrally molding the circular rotating plate 11 and the second blade parts 12*b* by a second mold.

After a preparation of the first and second molded products is completed, ends of the first upper blade parts 12*a* extended from the ring-shaped shroud 13 and ends of the second lower blade parts 12*b* extended from the circular rotating plate 11 are joined to each other by an ultrasonic fusion or a heat fusion, thus resulting in the turbofan 10.

The ends of the first upper blade parts 12a and the ends of the second lower blade parts 12*b*, which are joined to each other by the ultrasonic fusion or the heat fusion, are formed to have plane surfaces parallel to the front face of the circular rotating plate 11. Accordingly, since the first upper blade parts 12*a* and the second lower blade parts 12*b* have plane surfaces corresponding to each other, and the plane surfaces of the first upper blade parts 12*a* and second lower blade parts 12*b* are configured to be parallel to the front face of the circular rotating plate 11, a process of joining the first blade parts 12*a* to the second blade parts 12*b* is facilitated, and the first and second blade parts 12*a* and 12*b* are precisely (i.e., exactly) joined to each other. As a result of the exact joining, a defective fraction of the turbofans 10 produced is lowered, and a bonding strength of joining portions (lines designated by "A" in FIG. 4) is increased.

Figure 6:
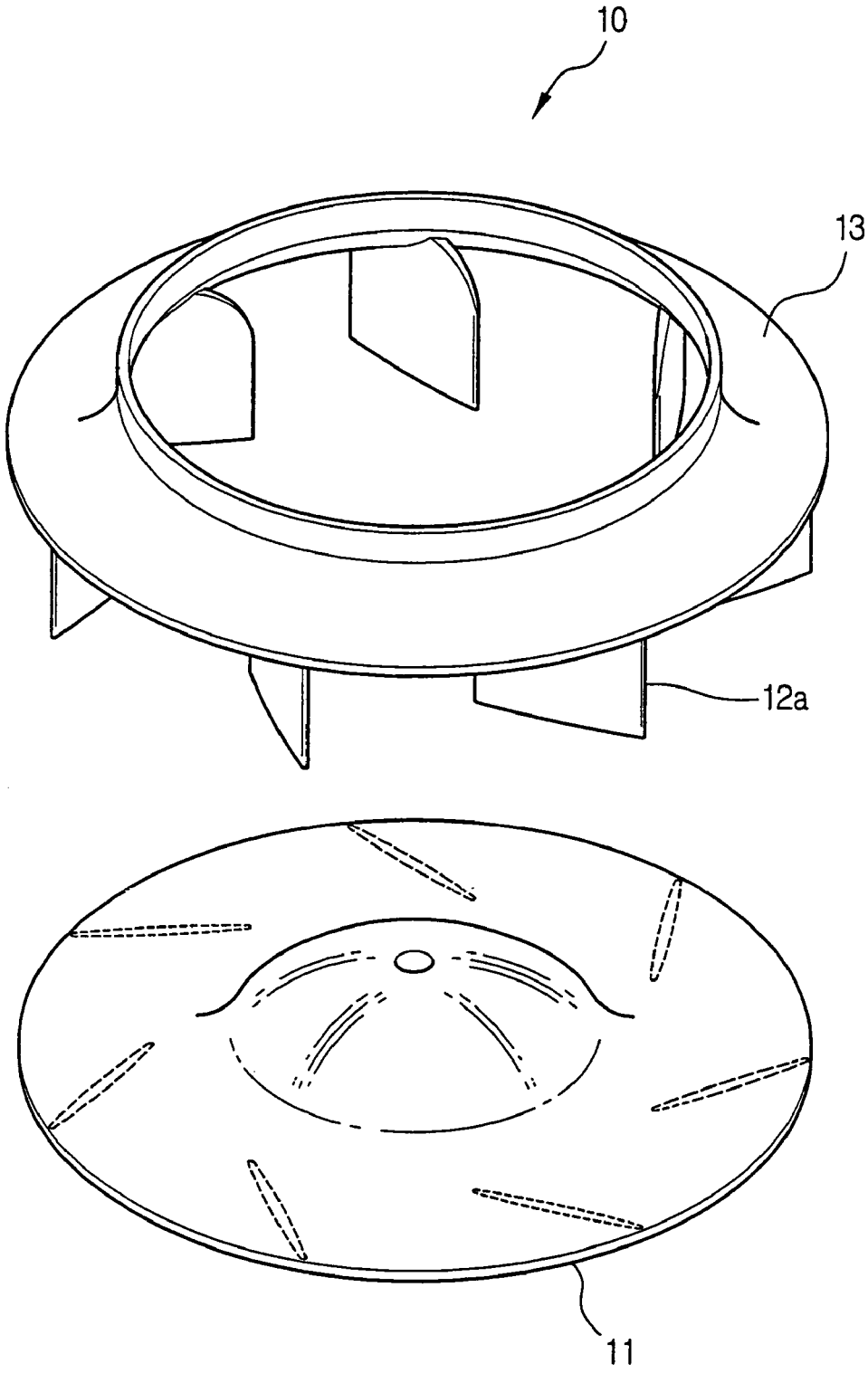
FIG. 6 is an exploded perspective view showing a process of manufacturing a turbofan, according to a third embodiment of the present invention.

FIG. 6 is an exploded perspective view showing a process of manufacturing a turbofan, according to a third embodiment of the present invention. As seen in FIG. 6, the process is carried out such that all of the plurality of blades 12 are integrally molded with the ring-shaped shroud 13 and the molded product is joined to a circular rotating plate 11, which is separately molded, by an ultrasonic fusion or a heat fusion, which is different from the second embodiment The joining portions of the turbofan 10 are positioned at boundary lines (lines designated by "B" in FIG. 4) between the plurality of blades 12 and the circular rotating plate 11. The end surfaces of the plurality of blades 12, which are joined to the circular rotating plate 11, are formed to have plane surfaces corresponding to the front face of the circular rotating plate 11 during a molding process, so as to enable the plurality of blades 12 to precisely join to the circular rotating plate 11.

As is apparent from the above description, a method of manufacturing a turbofan is provided, in which two molded turbofan parts join to each other at middle portions of a plurality of blades of the turbofan or at boundary portions between the plurality of blades and the circular rotating plate by a fusion bonding, and in which joining portions of the two turbofan parts are formed into plane surfaces corresponding to each other. As a result, one of the two turbofan parts is easily and precisely joinable to desired portions of the other of the two turbofan parts, thereby facilitating production of the turbofan and reducing defective fractions of turbofan products.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A turbofan with a drive motor, comprising:

a rotating plate coupled at a center thereof to a shaft of the drive motor;

a plurality of blades radially arranged on a peripheral area of a front face of the rotating plate, in which rear ends of the plurality of blades have plane surfaces corresponding to the front face of the rotating plate and are joined to the front face of the rotating plate by fusion bonding; and a ring-shaped shroud integrally formed with front ends of the plurality of the blades, wherein:

the blades and rotating plate are made of a resin material;

the front face of the rotating plate is bonded directly to the blades; and the fusion bonding is one of heat fusion and ultrasonic fusion.

2. A method of manufacturing a turbofan including a rotating plate coupled at a center thereof to a shaft of a drive motor, a plurality of blades radially arranged on a peripheral area of a front face of the rotating plate, and a ring-shaped shroud coupled to front ends of the plurality of blades, comprising:

forming the ring-shaped shroud and the plurality of blades integrally, in which ends of the plurality of blades have plane surfaces corresponding to the front face of the rotating plate; and joining the ends of the plurality of blades to the front face of the rotating plate by fusion bonding, wherein:

the blades and rotating plate are made of a resin material;

the front face of the rotating plate is bonded directly to the blades; and the fusion bonding is one of heat fusion and ultrasonic fusion.

3. A turbofan with a drive motor, comprising:

a shroud;

a rotating plate coupled to the drive motor to rotate the rotating plate; and a plurality of blades radially arranged on a front face of the rotating plate, each of the plurality of blades comprises:

front and rear ends such that the rear end of each of the plurality of blades has a plane surface corresponding to the front face of the rotating plate and is joined to the front face of the rotating plate and the front end of each of the plurality of blades is integrally formed with the shroud, wherein:

the blades and rotating plate are made of a resin material;

the front face of the rotating plate is bonded directly to the blades; and the fusion bonding is one of heat fusion and ultrasonic fusion.

4. A method of making a turbofan including a shroud, a rotating plate, and a plurality of blades radially arranged on a front face of the rotating plate, the shroud being coupled to front ends of the plurality of blades, comprising:

integrally molding the shroud and the plurality of blades, the front ends of the plurality of blades having plane surfaces corresponding to the front face of the rotating plate; and joining the front ends of the plurality of blades to the front face of the rotating plate, wherein:

the blades and rotating plate are made of a resin material;

the front face of the rotating plate is bonded directly to the blades; and the fusion bonding is one of heat fusion and ultrasonic fusion.

* * * * *